United States Patent [19]

Koenig

[11] Patent Number: 4,860,894

[45] Date of Patent: Aug. 29, 1989

[54] PACKAGE ASSEMBLY FOR GLASS FUNNEL PARTS

[75] Inventor: David G. Koenig, Reynoldsburg, Ohio

[73] Assignee: OI-NEG TV Products, Inc., Toledo, Ohio

[21] Appl. No.: 239,004

[22] Filed: Aug. 30, 1988

Related U.S. Application Data

[63] Continuation of Ser. No. 922,645, Oct. 23, 1986, abandoned.

[51] Int. Cl.[4] ..... B65D 85/42

[52] U.S. Cl. ..... 206/421; 206/499; 206/585; 206/589

[58] Field of Search ..... 206/328, 418–422, 206/426, 499, 519, 500, 525, 585, 589, 359, 365, 386; 217/26.5

[56] References Cited

U.S. PATENT DOCUMENTS

| | | | |
|---|---|---|---|
| 2,774,473 | 12/1956 | Williams | 217/26.5 X |
| 2,806,594 | 9/1957 | Muller et al. | 206/419 X |
| 3,360,150 | 12/1967 | Schechter | 217/26.5 |
| 3,637,073 | 1/1972 | Capuano | 206/328 X |
| 3,717,245 | 2/1973 | Brander et al. | 206/328 |
| 3,961,707 | 6/1976 | Lehr et al. | 206/419 |
| 4,088,225 | 5/1978 | Hartnell | 206/419 |
| 4,241,830 | 12/1980 | Di Gesû | 206/422 |
| 4,294,358 | 10/1981 | Nauheimer et al. | 206/419 |
| 4,311,239 | 1/1982 | Schlicker | 206/421 X |
| 4,643,314 | 2/1987 | Kidd | 206/386 X |
| 4,763,787 | 8/1988 | Koenig | 206/420 |

*Primary Examiner*—Bryon Gehman

[57] ABSTRACT

A package assembly is discosed in which base, trays and top cover are formed of hydrophobic materials. The base has skids and guide projections on its upper surface for positioning and restraining each of a plurality of video glass funnels in a layer of funnels on the base. A tray has a like plurality of upwardly extending funnel support components located to coincide with and rest on the upper surface of the funnels in the base layer. Each support component has a bowl-shaped configuration with an upper surface for supporting the larger open end of a funnel in a layer of funnels on top of the tray. Multiple layers of funnels are separated and supported by the trays. The top cover protects the uppermost layer of funnels and permits tying of the assembly into an integral unit through the use of encircling strapping bands, shrink wrap techniques, or the like.

7 Claims, 10 Drawing Sheets

PACKAGE ASSEMBLY FOR GLASS FUNNEL PARTS

This is a continuation of application Ser. No. 922,645, filed Oct. 23, 1986, now abandoned.

BACKGROUND OF THE INVENTION

1. Field of the Invention

This invention relates generally to package assemblies and, more specifically, to packages which are particularly useful for shipping frangible items, such as the glass funnel parts of video bulbs as disclosed in the embodiment shown herein. The invention is also directed toward package assemblies that have durable components that may be returned to the shipper many times for reuse.

2. Description of the Prior Art

The manufacture of television tubes is generally accomplished in two different plants, requiring the shipment of the glass component parts of the television tube from the component producing plant to a television tube or bulb assembly plant. In the past, the component producing plant manufactured a glass funnel having a relatively large, generally rectangular viewing end portion, to which a face plate is eventually integrally attached, and which tapered toward the other end down to a throat to which a neck tube was integrally attached.

A variety of special packages or containers, either corrugated or plastic or combinations thereof, have been disclosed in the prior art for shipping these unusually shaped glass components. Examples of these special packages are found in U.S. Pat. Nos. 4,294,359; 4,278,170; 4,088,225; 3,961,707; 3,930,579 and 3,494,535.

Recently, the manufacture of television tubes has changed in that the neck tube may now be attached to the tapered end of the funnel component at the bulb assembly plant, where the face plate is then secured to the funnel and electronic components are inserted into the neck tube. This, then, requires new methods and approaches for packaging the "neckless "funnels to conserve shipping space. It also offers an opportunity to provide more durable packaging with components which can be returned to the original shipper in compact form for reuse to reduce costs. Further, it has been found possible to design such packaging in a way which not only meets the requirements for shipping delicate glass television parts, but which also may be used for generic packaging of a number of other products.

Many reusable packages or containers have been disclosed in the prior art, with U.S. Pat. Nos. 4,454,946; 4,040,558 and 4,037,775 being examples that illustrate types of such packaging assemblies. However, these containers are not suitable for the unique and burdensome shipping and storage problems encountered with glass components for television bulbs. Such components are massive, yet extremely fragile. Not only must the components be protected from harm during the actual shipment, but the containers must be stackable to heights which can best utilize both warehouse and transport vehicle space. Collapse of stacked containers causes damage to the containers and often to their fragile contents.

In designing package assemblies to satisfy the requirements noted above the first priority is to conserve shipping space to reduce transportation costs. The conservation of space then increases the glass density in the pack, thereby substantially increasing the weight of the pack. This, then, adds the requirement of greater package strength to avoid rupture and other package damage and/or damage to the contents. Moreover, the increased weight requires design features that will ensure stability of the package and permit warehouse and shipping stacking.

It is important to design a package assembly which utilizes the least expensive materials while maintaining performance and functional characteristics discussed above. In addition, the shipping costs can be reduced further if the packaging materials can be returned to the shipper for reuse. Finally, if the package assembly components can be returned to the shipper in a manner that occupies the least possible space, further incremental cost reductions can be achieved.

In my copending application, Ser. No. 869,639, filed June 2, 1986, now U.S. Pat. No. 4,763,787, I have disclosed an improved package assembly that meets the above-noted requirements for shipping neckless glass funnels under most conditions. However, even the improved corrugated cardboard package assembly disclosed can be deteriorated by the rough handling, humid ambient conditions, and water saturation encountered in overseas shipping by cargo vessel. In addition, even though designed to take maximum advantage of its collapsible features, labor costs are involved in the assembly and disassembly of such packages. Further, the size of television picture tubes continues to increase, both in commonly advertised diagonal measurement of the face plate and in the trend toward squaring of the face plate. The diagonal increase and the squaring directly impact the size, and thus the weight, of the glass funnel which cooperates with the face plate. Thus, additional package improvements are highly desirable.

SUMMARY OF THE INVENTION

A package assembly for shipping a plurality of frangible parts is disclosed. Each part has a generally bowl-shaped configuration with contoured sides tapering from a larger open end toward a smaller end. Such frangible parts may be video glass funnels utilized in the manufacture of television bulbs. Such funnels have a larger, generally rectangular end for attachment of a face plate to the edge thereof, and a smaller end for attachment of a neck tube. Contoured side walls taper from the large end to the small end.

A base or pallet means is provided for receiving and supporting the larger ends of a plurality of frangible parts or glass funnels arranged in a first layer. A tray means is placed over the first layer of glass parts and a second layer of parts is placed on the tray. Several layers of glass parts separated by trays can be stacked on the base. Top cover means is then placed over the uppermost layer of parts to protect the upper surfaces of the parts in that layer, and to enable the binding of the stack into an integral unit by the use of tautly drawn encircling bands, shrink wrap techniques and the like.

The base includes guide means for engaging the larger open ends of the parts to restrain horizontal movement, which enhances the stability of vertical stacking of layers of funnels. The guides are preferably projections extending upwardly from the base to engage the outer or inner sides of the edge of a larger open end. A set of projections are located at intervals around an area defined by contact of the larger end with the base.

The base, as well as the other portions of the package assembly, is preferably formed from a synthetic plastic or other hydrophobic material to repel water and resist humid conditions. Each portion can be formed by suitable techniques, such as vacuum forming from a single sheet of high density polyethylene which can be 0.250 inches thick for the base. It is desirable to use a sheet of material that is as thin as possible to save material costs and design the element to provide functional features that also add strength and rigidity to the element. In the base design the leg means are preferably skids formed as an integral part of the base. The skids are spaced to define passageway means therebetween enabling reception of tines of a fork lift device to move the package assembly. The skids are formed as hollow elements which extend longitudinally along the underside of the base which adds strength and rigidity to the base.

The tray means includes a floor and a plurality of integral funnel support components extending upwardly therefrom at spaced locations corresponding in number and position to the plurality of funnels in the first layer. Each of the support components is generally bowl-shaped and has a lower surface configured to receive and mate with at least a portion of the upper surface of the contoured sides of a funnel lying below. The upper surface of the component receives and supports the larger open end of a frangible part or glass funnel on step means formed in the upper surface. The upper surface above the step means is shaped to avoid contact with the inner lower surface of the glass funnel.

The bowl-shaped configuration of the support component is preferably achieved by providing a plurality of ribs extending upwardly from the floor of the tray and sloping inwardly to define a generally pyramidal shape. The configuration further includes web means extending between and connecting the ribs. The web means has lower surfaces configured to receive and mate with upper surfaces of the contoured side walls of the funnel.

Each of the support ribs of a tray component has a step formed in the upper surface thereof for receiving the edge of a larger end of a funnel. The steps in all of the support ribs in the plurality of components of a tray are formed the same distance from the floor of a tray, thereby supporting all funnels in a layer on that tray at the same height enabling a second tray placed on top of that layer of funnels to be supported in a horizontal position to permit vertical stack building.

Each of the rib steps preferably has a horizontal wall and a substantially vertical wall which conforms to the taper of the inner surface of the side walls. The ribs are spaced apart so that when the horizontal walls of the steps support an attachment edge of a funnel the substantially vertical walls of the steps engage an inside surface of the funnel to substantially prevent lateral movement of a layer of funnels resting on the steps, thereby enhancing the stack building stability of the package assembly when successive layers of trays and funnels are added.

The ribs may contain a second or a plurality of series of steps formed in the ribs for supporting funnels of different sizes, thereby permitting the intermixing of funnel sizes in a shipment in the package assembly.

The top cover means has lower inner surfaces located and configured to receive and mate with at least a portion of the upper surfaces of the contoured side walls of a plurality of funnels in an uppermost layer. A hollow structure extends upwardly above each funnel surface reception area to protect the small end of each such funnel. Each hollow structure has a flat top panel to enable stacking of package assemblies on top of each other. Adjacent hollow structures are advantageously joined by hollow bridge elements enabling a reduction in thickness of the plastic material while still retaining the required strength and rigidity to support additional package assemblies stacked thereon.

The skid means on the base may include a third skid located intermediate the two outer, longitudinally extending skids, in order to add strength and rigidity to the base. The bridge elements may extend transversely between hollow structures and have an upper surface at the same level as the top panels of the hollow structures, thereby providing a support surface for the third skid of a base stacked on the top cover.

Transversely spaced and longitudinally extend ridges may be formed on the top panels of the cover means for cooperating with the skids of a base stacked thereon to position the upper package assembly in the proper vertical stacking arrangement and to prevent relative transverse movement between stacked package assemblies. Additional stop means may be provided for restraining horizontal movement in a longitudinal or transverse direction between stacked package assemblies. This additional means may include a plurality of male stops formed on one of the base and top cover means, and a plurality of corresponding female stops formed in the other of the base and top cover means.

It is, therefore, an object of this invention to provide an improved package assembly.

It is a further objective of this invention to provide an improved package assembly for shipping a plurality of neckless glass funnel parts for video bulbs which reduces labor costs normally associated with assembly and disassembly of returnable package assemblies.

It is an additional object of this invention to provide an improved package assembly which would enable the automation of the process of packaging neckless glass funnels thereby reducing the labor costs associated therewith.

Another object of this invention is to provide a package assembly which is particularly useful for shipping a plurality of larger glass funnel parts and/or shipping glass funnels in particularly difficult conditions, e.g. in overseas cargo ships.

Other objects, advantages and features of this invention will become more apparent during the course of the following description when it is read in conjunction with the accompanying drawings.

BRIEF DESCRIPTION OF THE DRAWINGS

In the drawings like numerals are employed to designate like parts throughout.

DESCRIPTION OF THE PREFERRED EMBODIMENT

Figure 1:
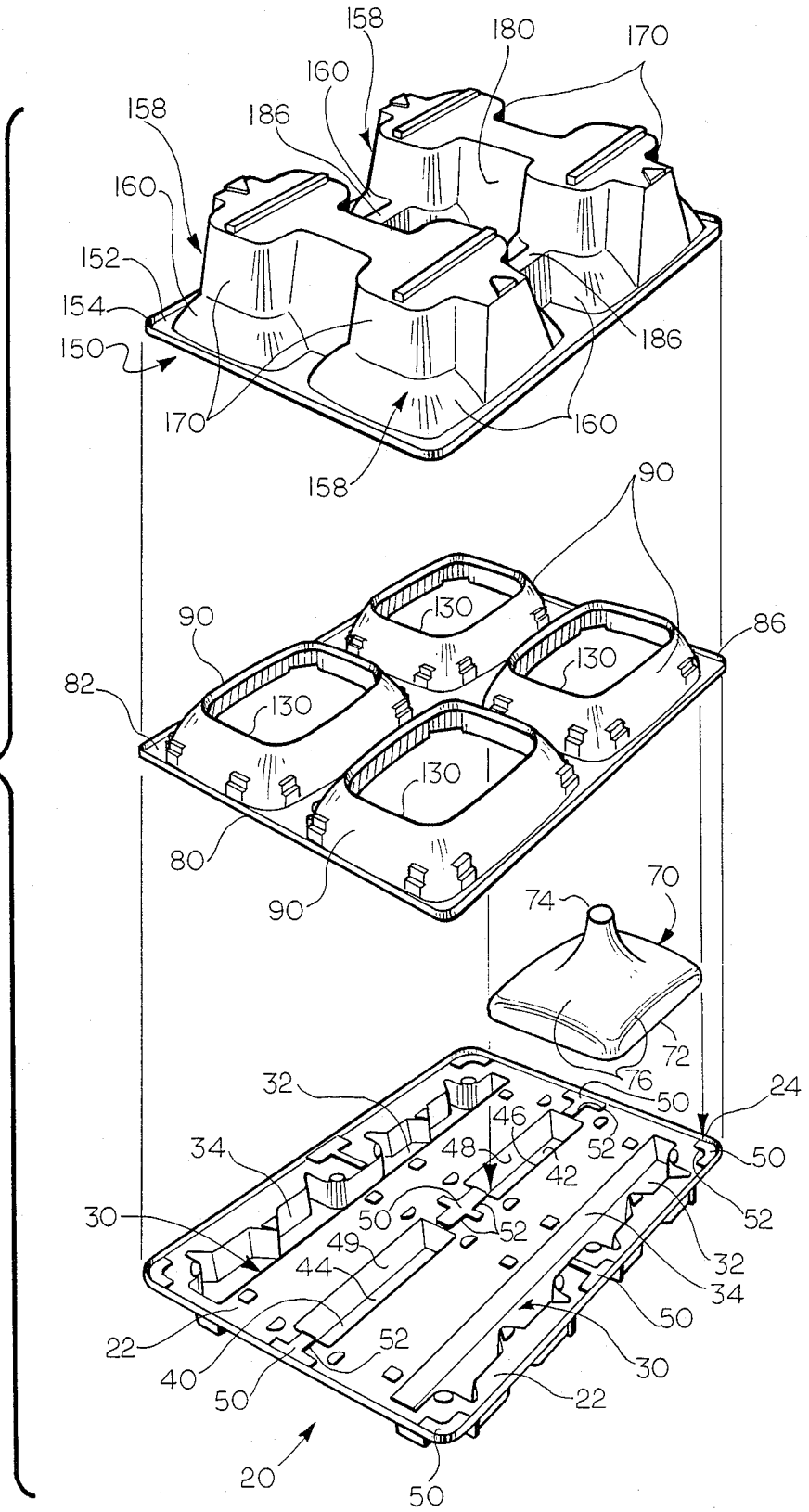
FIG. 1 illustrates an embodiment of the invention in an exploded, perspective view.

Referring now to FIG. 1 there is illustrated an embodiment of the teachings of this invention shown in an exploded perspective view. Details of the structure of the package assembly portions shown in FIG. 1 have been omitted, with major functional features highlighted, to provide an initial understanding of the invention. The omitted details are shown in and described in conjunction with subsequent drawings.

A base or pallet means 20 includes a floor 22 and an upwardly extending peripheral lip or flange. Downwardly extending leg means, shown here as outboard skids 30, run longitudinally along the under surface of base 20. Each skid has a bottom panel 32 and side walls 34 forming a hollow trough. An intermediate or center skid means has two sections 40, 42 with bottom panels 44, 46 and side walls 48, 49 forming hollow troughs.

Guide projections 50 extend upwardly from the floor 22 of the base 20 to restrain funnels 70 from horizontal movement. The projections 50 have funnel retaining walls 52 to engage the edges 72 and/or the inner or outer side walls 76 adjacent the edges 72 of a neckless glass funnel 70.

Similar guide projections 54 and 56 at different selected spaced locations (See FIG. 2) extend upwardly from floor 22 and have side walls such as shown at 58 for restraining intermediate and smaller size funnels against horizontal movement. These projections operate in sets to maintain the funnels 70 in a desired location and enhance the building and stability of a vertical stack, of layers of funnels and trays 80 separating the layers, on base 20.

Figure 2:
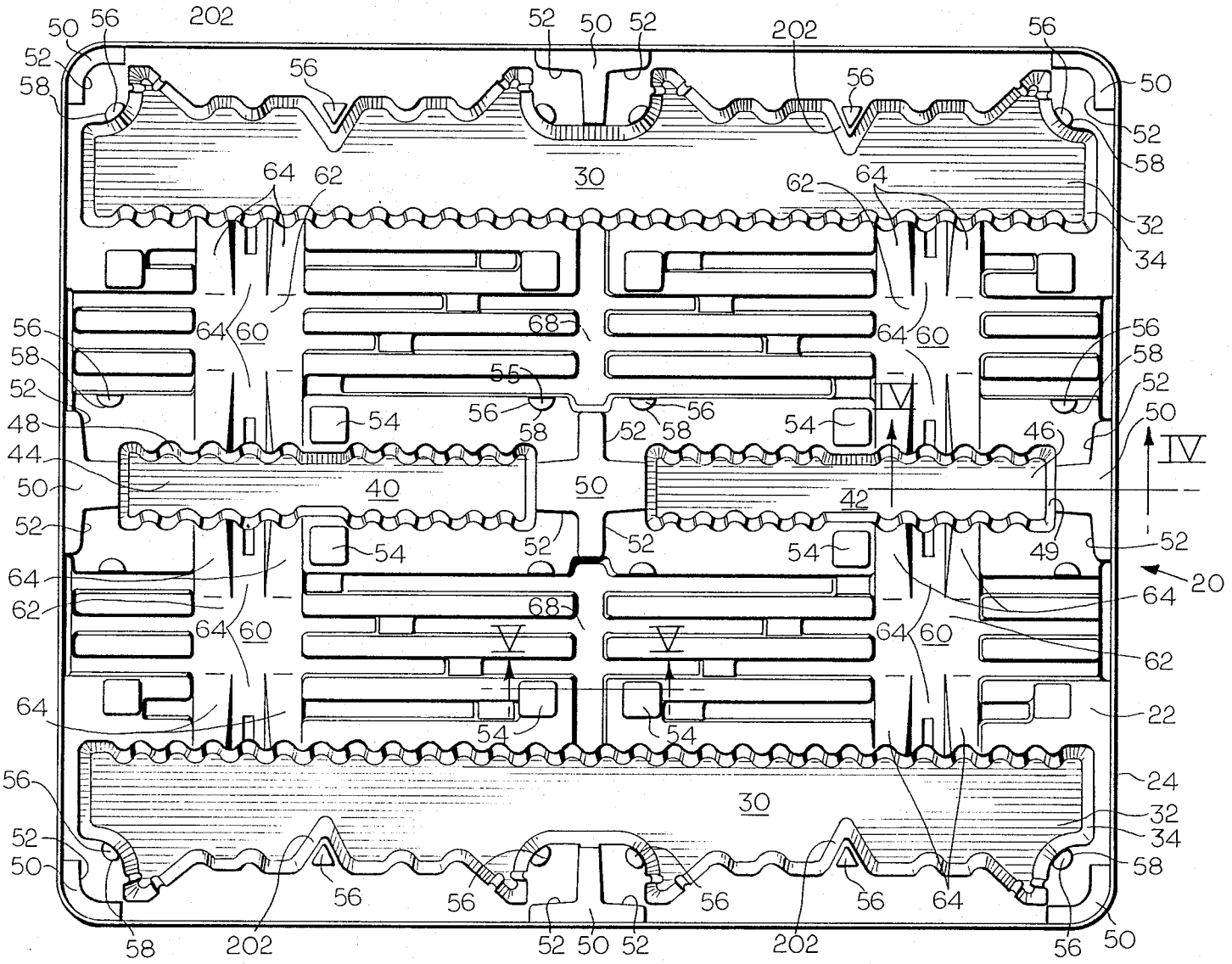
FIG. 2 is a plan view of a base or pallet.
Figure 3:
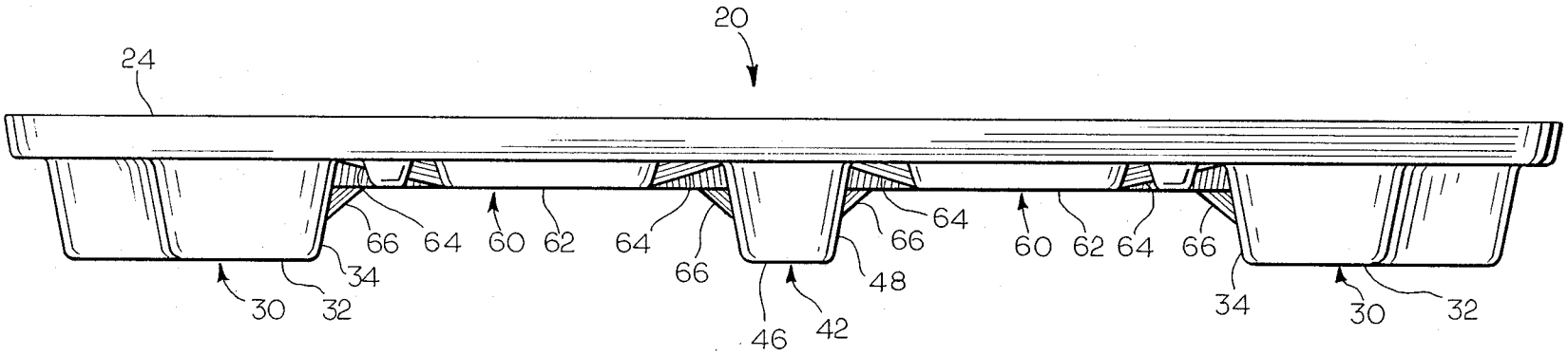
FIG. 3 is an end elevational view of the base of FIG. 2.
Figure 4:
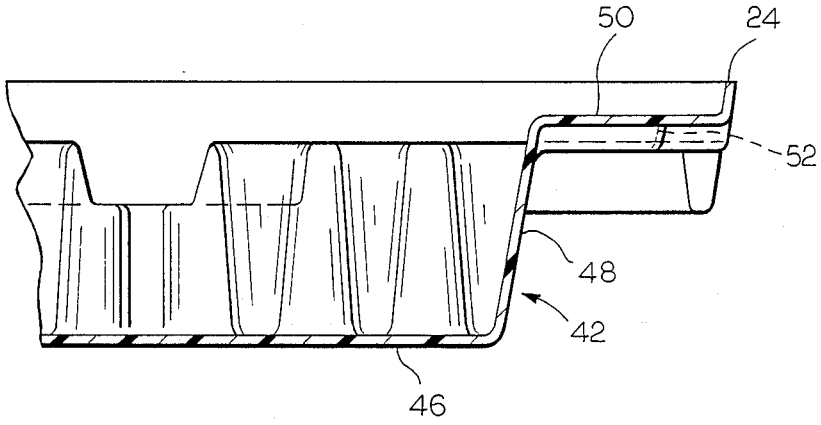
FIG. 4 is an enlarged cross-sectional view of a portion of the base taken along lines IV—IV of FIG. 2.
Figure 5:
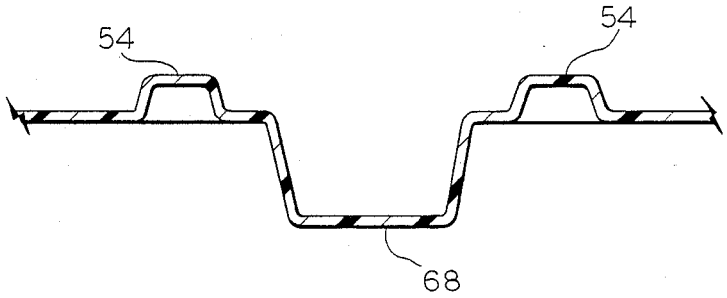
FIG. 5 is an enlarged cross-sectional view of a portion of the base taken along lines V—V of FIG. 2.
Figure 6:
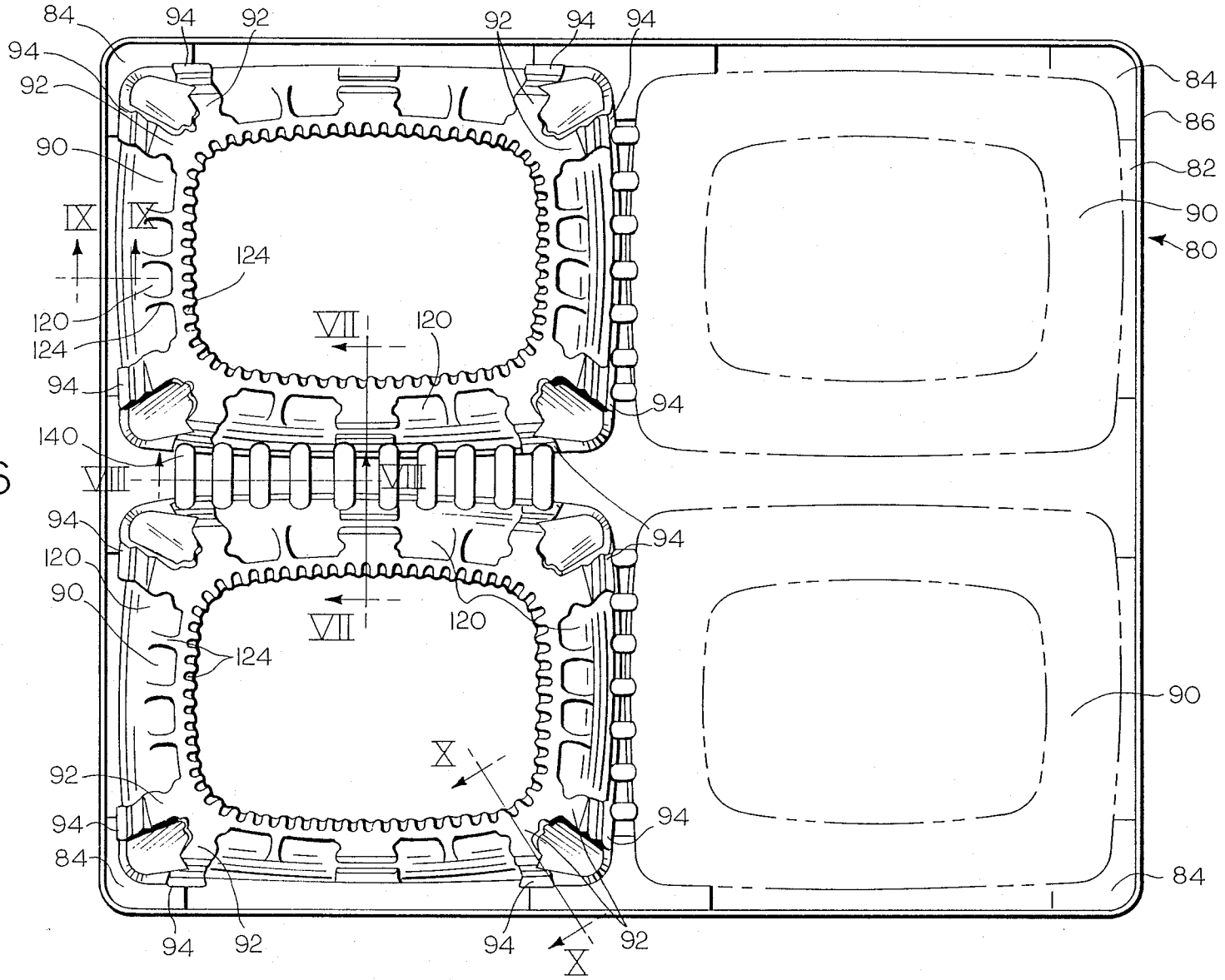
FIG. 6 is a plan view of a layer separation and support tray.

The skids 30, 40 define passageways (See FIG. 3) therebetween for the reception of tines of a fork lift device for easy handling and moving of the package assemblies. Fork lift pads 60 as seen in FIGS. 2 and 3 comprise horizontal pad floors 62 for tine contact, inclined arch elements 64, and reinforcing troughs 66. This combination provides a flat surface for reception of the tines while elements 64 provide an inverse arch to add strength and ridigity to the base and pads 60. As seen in FIGS. 2 and 5 a trough 68 provides rigidity and may act as a secondary fork lift pad.

The neckless video glass funnel parts 70 are illustrated in FIG. 1 and have larger open ends 72 to which face plates are attached, smaller ends 74 to which neck tubes are attached, and contoured side walls 76 tapering from the larger ends to the smaller ends. The funnels 70 rest on the base 20 with the larger ends 72 down and held in place by guide projections 50.

The base or pallet means 20, as well as the tray means 80 and top cover means 150, is preferably formed from a hydrophobic material such as a synthetic plastic to repel water and resist humid conditions. Each can be formed by suitable techniques such as vacuum forming from a single sheet of high density polyethylene. It is desirable to use a sheet of material that is as thin as possible to both make the forming process easier and to conserve on material costs. For example, the base 20 can be formed from a 0.25 inch sheet of such polyethylene. The element must then be designed so that the functional features also add strength and rigidity.

In the base design the upturned peripheral lip 24 imparts strength and rigidity. Forming leg means in the shape of longitudinally extending hollow trough skids 30, 40, and 42 provides substantial strength and rigidity. The integrally formed fork lift pads 60 with their inverse arch design, and the secondary fork lift pad 68, add strength and rigidity to the entire structure as well as specific reinforcement to the contact areas for tines of a fork lift device. Alternating trough and rib structures or corrugations in both longitudinal and transverse directions and shown in FIG. 2, but not specifically described, also add strength and rigidity. Reinforcing bridges or webs as shown between the walls of such alternating troughs also add strength and rigidity. The upwardly extending guide projections 50, 54 and 56 contribute to strength and rigidity.

Another important feature in the design of reusable package elements of rigid materials is to ensure that such package elements can be nested together for return to the original shipper in the most compact form. Therefore, as can be seen in the drawings, various structural parts have inclined walls to facilitate such nesting. For example, all peripheral flanges or lips are inclined outwardly. The side walls of the hollow troughs of the skids are inclined, so that the smaller bottoms of an uppermost skid can nest in the larger top opening of a hollow skid therebeneath. These inclined walls can also contribute to the strength and rigidity of an element.

Referring now to FIGS. 6 through 10 there is illustrated a tray means 80 for supporting and separating layers of glass funnels 70 stacked on base 20. The tray 80 includes a floor portion 82 with elevated floor portions 84 in the corners, center and midway along each side. The elevated floor portions 84 are raised so that they fit over guide projections 50 formed on the floor 22 of the base 20 and under similar elevated floor portions of a tray stacked above, permitting closer nesting when a plurality of empty trays are stacked on a base 20 to form a compact package for return to a shipper for reuse. In addition, elevated floor portions 84 cooperate with the upwardly extending peripheral lip or flange 86 to provide strength and rigidity to the tray 80.

The tray 80 further includes a plurality of upwardly extending, integral, generally bowl-shaped frangible part or funnel support components 90. The plurality of components 90 coincide in location to the like plurality of funnels 70 in the first layer resting on base 20. The components 90 have lower surface means configured to receive and mate with at least a portion of the upper surface of the contoured sides of a frangible part in layer of such parts below the tray. The components 90 also have upper surface means for receiving and supporting the larger open end of a part in a layer of such parts located above and resting on the tray.

In the specific embodiment shown in FIGS. 6 through 10, the support for funnels above the component 90 is provided by plurality of ribs 92 extending upwardly from the floor 82 of the tray 80 and sloping inwardly to define a generally pyramidal shape. A first series of steps 94 are formed in the upper surface of ribs 92 of a component. The steps 94 include a horizontal wall 96 to receive and support the edge of a larger end of a funnel, and a substantially vertical wall 98 which preferably conforms to the taper of the inner surface of the side walls of a funnel to substantially prevent lateral movement of funnels resting on the steps 94. This combination enhances the stack building stability of the package assembly when successive layers of funnels and trays are added.

A second and third series of steps 100, 106 with respective horizontal walls 102, 108 and substantially vertical walls 104, 110 receive and support intermediate and smaller funnels in the same fashion as the first series of steps. Different sizes of funnels can thus be intermixed in a shipment in the package assembly. Each step in each series of steps is formed in the ribs the same distance from the floor 82 of the tray 80, thereby supporting the funnel edges horizontally with respect to the floor and at the same height as other funnels in the layer to permit vertical stack building.

Web means 120 extend between and connect the lower surfaces of the ribs 92. The lower surfaces 122 (See FIG. 10) are configured to receive and mate with at least a portion of the upper surfaces of the contoured side walls 76 of the funnels 70.

The upper surface of the component 90 above the step means is shaped to avoid contact with an inner surface of a funnel supported on the step means. Since the components 90 are preferably molded or formed from synthetic plastic materials and since there is no contact of the upper inner surface of a funnel, additional resiliency and spring action is provided in the rib and web construction to absorb shock and compression forces. Yet the construction can return from deformation caused by such forces to permit reuse again and again.

It can be seen that the structure provides shock absorbing for the formula in a stack of funnels. That is, each rib 92 has innermost edges and an outermost upper surface spaced from the innermost edges as noted above. As further noted above, means connect the innermost edges of the ribs and each of the ribs have a series of steps formed in the upper surface thereof for receiving the larger ends of the funnel. Each step is formed with the above-noted horizontal and vertical walls which intersect partially through the depth of a rib. The intersection is spaced from the innermost edges of the rib to maintain and provide a shock absorbing space between the lower larger end of an upper funnel on and the upper surface of a funnel below the component 90, to prevent contact of plastic supporting a large end of a funnel with the upper surface of the funnel below in the stack.

Figure 7:
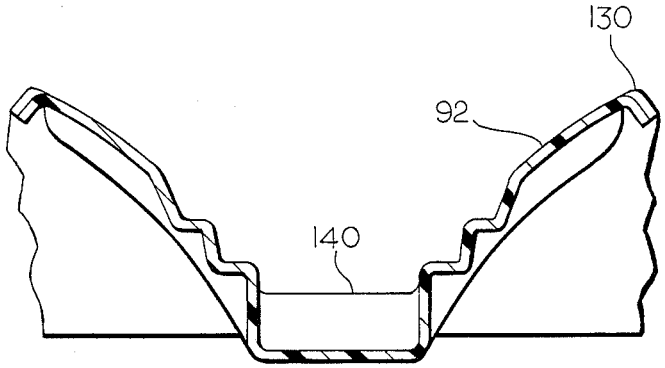
FIG. 7 is a cross-sectional view of the tray taken along lines VII—VII of FIG. 6.
Figure 8:
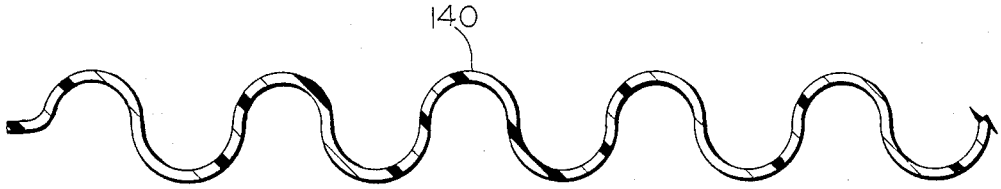
FIG. 8 is an enlarged cross-sectional view of the tray taken along lines VIII—VIII of FIG. 6.
Figure 9:
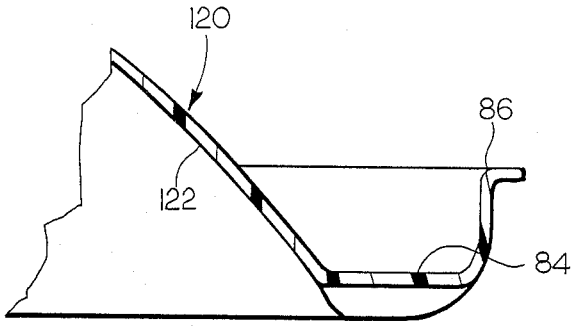
FIG. 9 is an enlarged cross-sectional view of a portion of the tray taken along lines IX—IX of FIG. 6.
Figure 10:
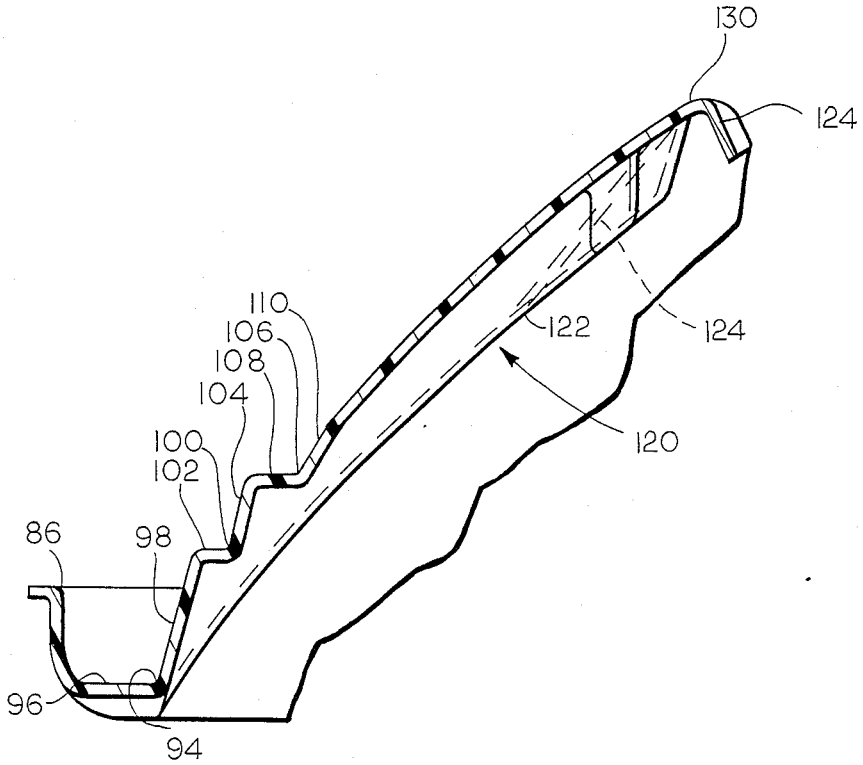
FIG. 10 is an enlarged cross-sectional view of a portion of the tray taken along lines X—X of FIG. 6.

The ribs 92 and web means 120 terminate in an apex rim 130 which defines an opening in the upper portion of the component 90 which permits the smaller end 74 of a funnel to protrude upwardly therethrough. Rim and web reinforcement ridges 124 provide further support for the structure. Corrugations 140, best seen in FIGS. 7 and 8, provide strength and rigidity to the tray 80.

Figure 11:
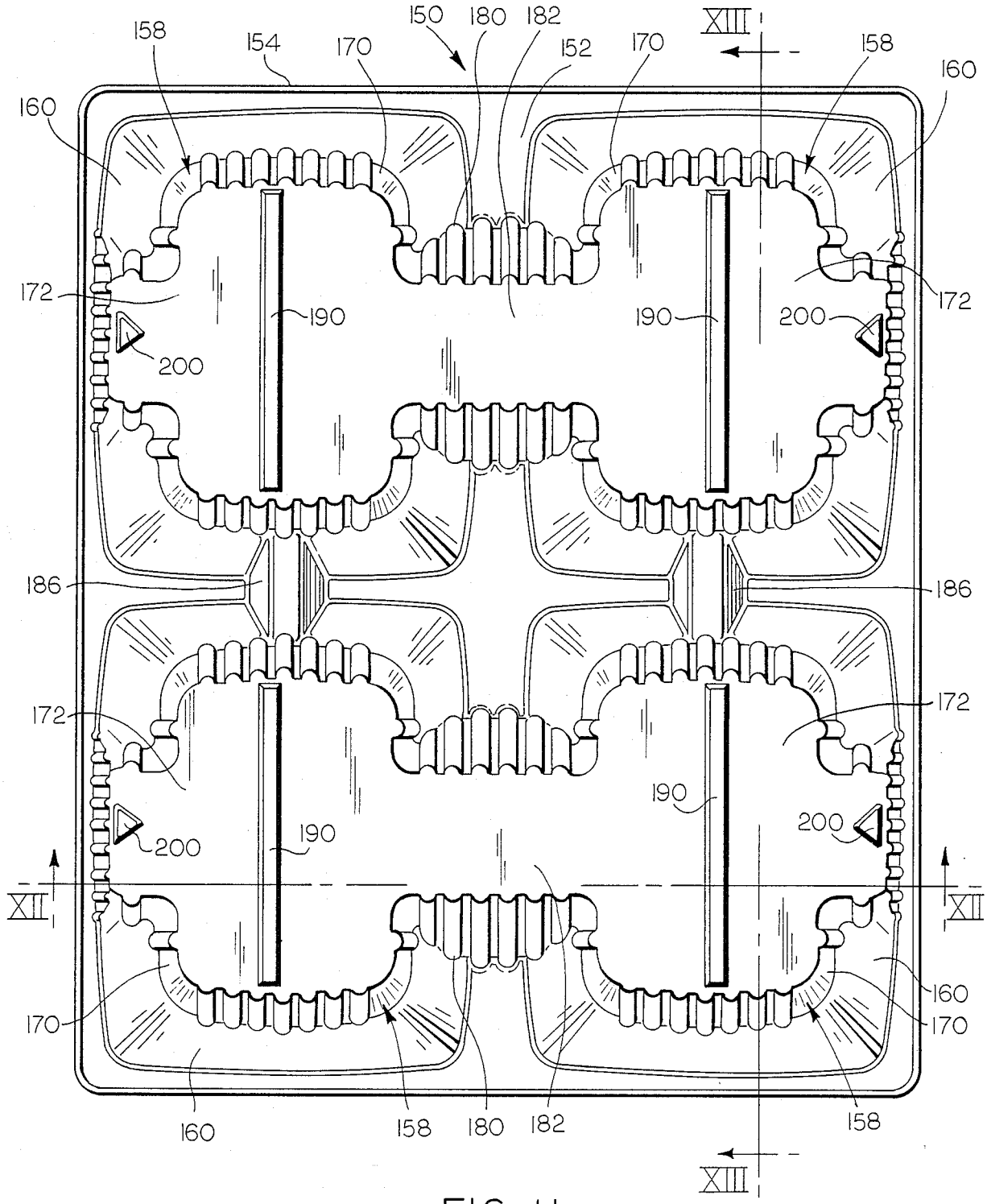
FIG. 11 is a plan view of a top cover for the package assembly.
Figure 12:
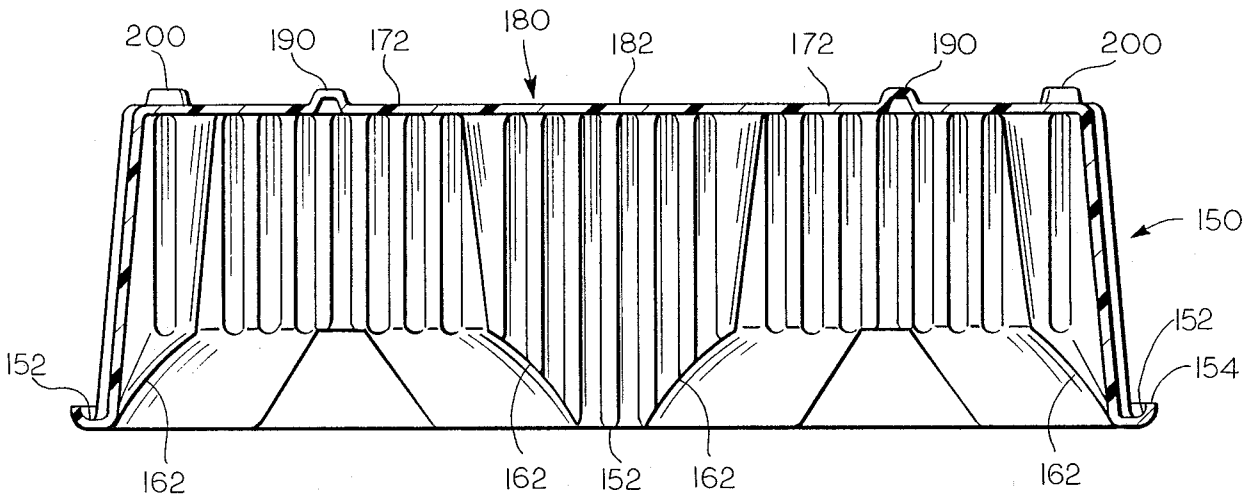
FIG. 12 is a cross-sectional view of the top cover taken along lines XII—XII of FIG. 11.
Figure 13:
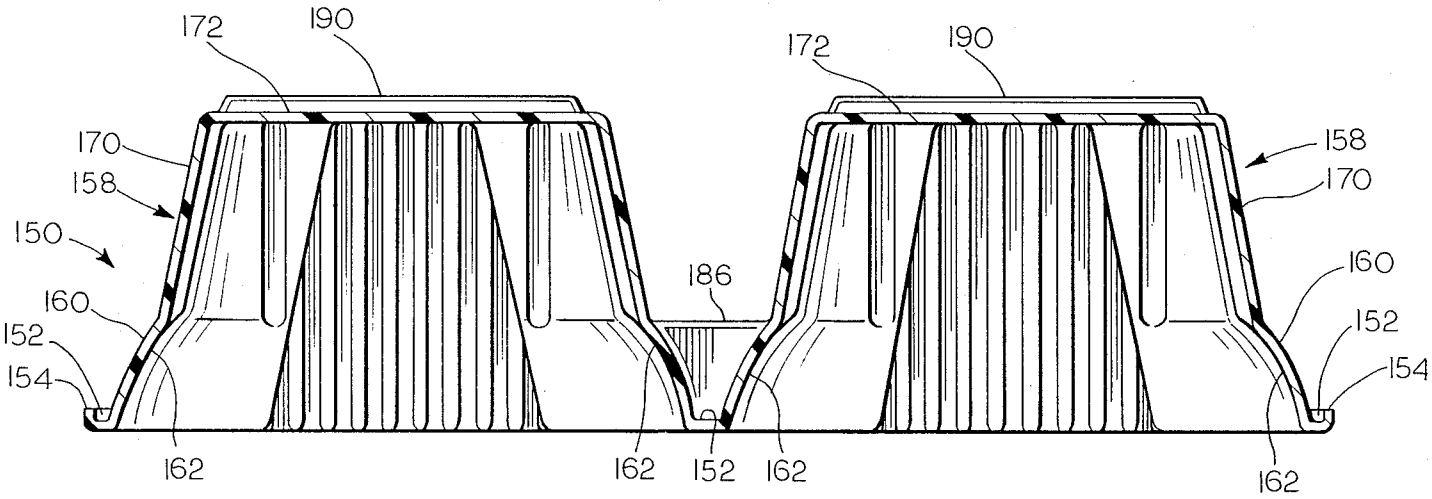
FIG. 13 is a cross-sectional view of the top cover taken along lines XIII—XIII of FIG. 11.

A top cover means 150 is illustrated in FIGS. 11 through 13 and includes a floor 152 and a peripheral upwardly extending flange or lip 154 for nesting, strength and rigidity as discussed hereinbefore. The top cover has a plurality of funnel protection elements 158 which includes a lower body portion 160 extending upwardly from the floor 152. The plurality of elements 158 coincide in location to the like plurality of funnels 70 supported on a tray 80 below the cover 150. The lower body portions 160 are generally bowl-shaped and have lower inner surfaces 162 (See FIGS. 12 and 13) configured to receive and mate with at least a portion of the upper surfaces of the contoured side walls of a funnel on which the cover means is resting.

The funnel elements 158 also have hollow stack structures 170 extending upwardly from the lower body portions 160, preventing any contact with and thus protecting the neck attachment area and adjacent surfaces of a funnel. The hollow structures 170 have flat top panels 172 to enable stacking of package assemblies on top of each other.

Adjacent hollow structures 170 are joined by primary and secondary hollow bridge elements 180, 186 to add strength and rigidity to the top cover and enable a reduction in thickness of the plastic stack material from which it is formed. Adequate strength is thus obtained to enable the stacking of several such package assemblies on top of each other. The primary bridge elements 180 have top panels 182 that are preferably at the same level as the top panels 172 of the stack structures 170, thereby forming a transverse surface for receiving and supporting the center skids 40, 42 of a base 20 which is stacked on top of the cover means 150. The stacks 170 and bridges 180 advantageously have vertical corrugations formed in the side walls thereof to impart compression strength and rigidity.

Transversly spaced ridge means 190 formed on the top panels 172 of the stack structures 170 are located to correctly position the stacked base for proper vertical stacking of the package assemblies. The ridge means 190 also acts as a stop means to prevent relative transverse movement between stacked package assemblies. The ridges 190 also resist bending of the top panels 172 and add further strength.

Further stop means may be used to prevent all relative horizontal movement between stacked package assemblies, whether longitudinal or transverse. A plurality of male stop means 200 may be formed on the top panels 172 along the outer edges of the stack structures 170. Female detent or stop means 202 are formed in the outer edges of skids 30 (best seen in FIG. 2) as triangular notches to receive the triangularly shaped male detents 200.

A full shipment in the package assembly disclosed herein would include multiple tiers or layers of frangible part or funnel holding shelves or trays resting on a first layer of funnels sitting on the base. A top cover is placed over the uppermost layer of funnels. The entire assembly is then tied into an integral unit for shipping and stacking by the use of tautly drawn bands encircling the assembly, the use of shrink wrap techniques, or like methods. The curled, upstanding peripheral lips or flanges on the package parts minimize the possibility of rupturing encircling bands.

When the assemblies are unpacked, the package components may be stacked in the nested fashion described hereinbefore because of the inclined walls of the hollow portions. This provides compact, space saving and low cost returns of the package components to the original shipper. Labor costs are reduced because there is no assembly or disassembly of co11apsible components, there is no major sorting or inventory control problem because there are only three different package components, and the package assembly is adaptable to automated packing techniques since the contoured surfaces and design tends to guide the layers of funnels, tray separators and supports, and top covers into the proper positions. Manufacturing costs are reduced because only three molds are needed for the production of the three package components. While the package assembly can handle the greater glass density associated with larger funnels, the components are relatively light in weight because of the design techniques used to increase the strength and rigidity of the parts.

It is to be understood that the form of the invention shown and described herein is to be taken as an illustrative embodiment only, and that various changes in the shape, size and arrangement of the parts may be made without departing from the spirit and scope of the invention.

I claim:

1. A package assembly for shipping a plurality of video glass funnel parts, wherein each glass part has a larger end for attachment of a face plate to the edge thereof and a smaller end for attachment of a neck tube and with contoured side walls tapering from the larger end to the smaller end, comprising;

(a) base means for receiving and supporting in spaced locations the larger ends of a plurality of video glass funnels arranged in a first layer, (b) tray means for supporting a second layer of funnels including a floor and a plurality of integral funnel support components extending upwardly from said floor at locations corresponding in number and position to said plurality of funnels in said first layer, (c) each of said funnel support components including a plurality of ribs extending upwardly from the floor of said tray means and sloping inwardly to define a generally pyramidal shape, each rib having innermost edges and an outermost upper surface spaced from said innermost edges, (d) each said funnel support component further including web means for connecting said innermost edges of said ribs, said web means having lower surfaces configured to receive and mate with at least a portion of the upper surfaces of the contoured side walls of a funnel in a layer below said tray means, (e) each of said ribs of a funnel component having a step formed in said upper surface thereof for receiving the edge of a larger end of a funnel in said second layer, each step being formed with a substantially horizontal wall to positively locate and firmly support a funnel edge and a substantially vertically extending wall, the two walls intersection partially through the depth of a rib to provide a shock absorbing space between funnels on and below said components, the horizontal walls of the steps in all ribs in the plurality of support components of a tray means being formed the same distance from the floor thereby supporting all funnels in the layer on that tray means at the same height enabling additional tray means to be supported above in a horizontal position to permit vertical stack building, and (f) top cover means for protecting the upper surfaces of an uppermost layer of funnels supported on a tray means.

2. A package assembly as defined in claim 1 in which (a) the substantially vertical wall of said rib steps conforms to the taper of the inner surface of the side walls of a funnel, and in which (b) said ribs are spaced apart so that when the horizontal walls support an attachment edge of a funnel the substantially vertical walls of the steps engage an inside surface of a funnel to substantially prevent lateral movement of a layer of funnels resting on said steps, thereby enhancing the stack building stability of said package assembly when successive layers of tray means and funnels are added.

3. A package assembly as defined in claim 1 which further includes a second series of such step formed in and further up said ribs for supporting funnels of a different size, thereby permitting the intermixing of layers of funnel sizes in a shipment in said package assembly.

4. A package assembly as defined in claim 1 in which said base means including guide projections for engaging the large ends of funnels supported thereon to restrain funnels in the layer against horizontal movement thereby enhancing the stability of vertical stacking of layers of funnels in a package assembly.

5. A package assembly as defined in claim 1 in which (a) a said top cover means having inner surfaces configured to receive and mate with at least a portion of the upper surfaces of the contoured side walls of a plurality of funnels in a layer on which said cover means is resting, (b) said cover means further having a hollow structure extending upwardly above each funnel surface reception area to protect the small end of each funnel, (c) each said hollow structure also having a top panel to enable stacking of package assemblies on top of each other, (d) adjacent hollow structures being joined by bridge elements enabling retaining required strength and rigidity necessary to support additional package assemblies to be stacked thereon.

6. A package assembly as defined in claim 5 which further includes (a) a plurality of skid elements on the bottom of said base means, and in which (b) said bridge elements extend transversely between and the upper surfaces thereof are at the same level as said top panels of said hollow funnel protectors thereby providing extended transverse support surfaces for receiving a plurality of skid elements on the base member of another package assembly even though a skid element is located intermediate two hollow funnel protectors.

7. A package element as defined in claim 5 which further includes transversely spaced ridge means formed on said top panels of said cover means for cooperating with said skid elements of a package assembly stacked thereon to position the upper package assembly in the proper vertical stacking arrangement and to prevent relative transverse movement between stacked package assemblies.

* * * * *